US008016112B2

(12) United States Patent
Kasiwabara

(10) Patent No.: US 8,016,112 B2
(45) Date of Patent: Sep. 13, 2011

(54) PACKING IMPLEMENT FOR THIN ARTICLE TRANSPORTATION

(75) Inventor: Kouichi Kasiwabara, Tokyo (JP)

(73) Assignee: Yamato Packing Technology Institute Co., Ltd., Tokyo (JP)

( * ) Notice: Subject to any disclaimer, the term of this patent is extended or adjusted under 35 U.S.C. 154(b) by 0 days.

(21) Appl. No.: 12/735,775

(22) PCT Filed: Jun. 13, 2008

(86) PCT No.: PCT/JP2008/060840

§ 371 (c)(1),
(2), (4) Date: Aug. 17, 2010

(87) PCT Pub. No.: WO2009/104287

PCT Pub. Date: Aug. 27, 2009

(65) Prior Publication Data

US 2010/0320112 A1 Dec. 23, 2010

(30) Foreign Application Priority Data

Feb. 22, 2008 (JP) ..... 2008-041807

(51) Int. Cl.
*B65D 81/02* (2006.01)

(52) U.S. Cl. ..... 206/583; 206/521; 206/591; 206/592

(58) Field of Classification Search ..... 206/583, 206/591, 594, 521, 462, 463, 775, 776, 777, 206/778, 466, 588, 592
See application file for complete search history.

(56) References Cited

U.S. PATENT DOCUMENTS

| | | | | |
|---|---|---|---|---|
| 3,089,590 | A | 5/1963 | Mell | |
| 5,259,507 | A * | 11/1993 | Smith | 206/583 |
| 5,678,695 | A | 10/1997 | Ridgeway et al. | |
| 5,967,327 | A * | 10/1999 | Jones | 206/583 |
| 6,289,655 | B1 * | 9/2001 | Ridgeway et al. | 53/449 |
| 6,302,274 | B1 * | 10/2001 | Ridgeway | 206/583 |
| 6,311,843 | B1 * | 11/2001 | Smith et al. | 206/583 |
| 6,675,973 | B1 | 1/2004 | MacDonald et al. | |
| 7,086,534 | B2 * | 8/2006 | Roesel et al. | 206/583 |
| 7,770,734 | B2 | 8/2010 | Saitou et al. | |
| 2006/0000743 | A1 * | 1/2006 | Lofgren et al. | 206/583 |
| 2006/0102515 | A1 * | 5/2006 | McDonald et al. | 206/583 |

FOREIGN PATENT DOCUMENTS

| | | |
|---|---|---|
| JP | S61-5760 U | 1/1986 |
| JP | H02-16718 U | 2/1990 |

* cited by examiner

*Primary Examiner* — David Fidei
(74) *Attorney, Agent, or Firm* — Manabu Kanesaka

(57) ABSTRACT

To stably hold and pack a thin card-shaped article.
A packing implement for article transportation includes a board 1 and a holding sheet 2. The board 1 is sectioned into a base 3 and a cover 4, and the cover 4 has a window hole 5, and the holding sheet 2 is stuck over the window hole 5. On the base 3, an article M is placed, and the cover 4 is folded double over the article, and further, the base 3 and the cover 4 are folded integrally along opening edges of the window hole 5 to build up a three-dimensional packing implement. By folding the base 3 and the cover 4, the holding sheet 2 facing the inside of the window hole 5 is tensioned, and the article M is pressed down by the holding sheet 2 and held at a fixed position on the base 3. The packing implement 8 packing the article M is housed as it is in an outer case 9.

8 Claims, 3 Drawing Sheets

PACKING IMPLEMENT FOR THIN ARTICLE TRANSPORTATION

TECHNICAL FIELD

The present invention relates to a packing implement for thin article transportation, which is used to house and transport a small card-shaped article such as a portable digital music player (iPod (trade name)), specifically, to a packing implement for thin article transportation suitable for home delivery services.

BACKGROUND ART

For example, for transportation of a notebook computer, shipment of a product from a manufacturer to a shop, and transportation of goods from a shop to a buyer, home delivery service is usually used. When transporting a notebook computer by mail or home delivery service, as regards its packing, measures for sufficiently protecting the notebook computer from impacts that may be applied to the notebook computer during transportation must be taken.

Measures must also be taken not only for notebook computers but also for audiovisual products, cell phones, and game machines, etc. Measures must also be taken for other IT products. Recently, goods such as portable digital music players (iPod (trade name)) are becoming increasingly popular, and the need to transport such goods is increasing.

Not only thin goods, but also goods in general need to be packed when they are transported, and when transporting goods, the boxing of goods (packing goods in a box) with buffer materials has been unable to keep up with demand depending on the kind of goods. The above-described kind of goods are sensitive to impacts, and in order to carefully handle the goods, the packing inevitably becomes large-scale, and the packing work requires a great deal of care and time. Therefore, it has been greatly demanded to develop a packing implement which simplifies the goods packing work and effectively protects goods from impacts that may be applied during transportation.

To meet this demand, as a packing implement suitable for transportation of goods which are thin but have a size similar to the extent of a notebook computer, a packing implement including a combination of a baseboard and a holding sheet, the ends of which are stuck to the baseboard was first developed.

This packing implement is basically structured so that an article is sandwiched between the baseboard and the holding sheet, both end portions and both side portions of the baseboard are folded up and down, and the holding sheet is tensioned and the article is closely fixed to the baseboard (refer to Patent document 1).

The inventor repeatedly improved this packing implement and took various measures at the folding portions of the baseboard, and developed a packing implement which effectively protects an article from impacts that may be applied during transportation by forming buffer spaces at the upper, lower, left, and right portions of the packing implement when the article is packed by the packing implement and housed in an outer case (refer to Patent document 2).

Although the above-described packing implement is intended for packing thin goods, the packing implement is intended for packing goods which are thin but have a size or thickness similar to the extent of a notebook computer, so that in order to fix a small and thin card-type article such as a portable digital music player (iPod (trade name)) at a fixed position on the baseboard, it is understood that the tension of the holding sheet inevitably becomes insufficient.

Patent document 1: Specification of U.S. Pat. No. 5,568,695

Patent document 2: Japanese Published Unexamined Patent Application No. 2006-248549

DISCLOSURE OF THE INVENTION

Problem to be Solved by the Invention

The problem to be solved by the present invention is that the degree of tension of the holding sheet inevitably becomes insufficient for fixing a small and thin card-shaped article such as a portable digital music player (iPod (trade name)) to a fixed position on the baseboard of the packing implement described in Patent document 2.

Means for Solving the Problem

According to the present invention, a packing implement including a board made of corrugated cardboard is the board surface of which is sectioned into a base and a cover, having a window hole opened therein, and a holding sheet stuck over the opening edges of the window hole, is used to sandwich a small and thin card-shaped article as a commercial product between the base and the cover, the base and the cover are folded integrally along the opening edges of the window hole, the tensile force of the holding sheet is increased, and the thin card-shaped article is pressed against the base and reliably fixed to a fixed position on the base, and is stored as it is in an outer case.

Effects of the Invention

A thin card-shaped article is placed on the base, the cover is overlaid on the article, and both side edges of the cover are folded down together with the base along the opening shapes on both sides of the window frame, and accordingly, the plain shape of the packing implement is deformed into a drum (Japanese instrument "TUDUMI") shape which has a constriction at the central portion so as to become narrow in width at the central portion and wide in width at both ends, and when the deformed packing implement is housed in an outer case, the four corners of the packing implement are supported on the four corners of the outer case and the drum shape is kept, the central portion of the window frame of the holding sheet is strongly pulled to both sides along the opening shape of the window frame, and according to tension of the holding sheet, the thin card-shaped article placed on the base is strongly pressed onto the base and can be fixed to the fixed position.

When flaps are provided so as to project to the inner side of the opening of the window hole and be opposed to each other, by folding both side edges of the cover down together with the base along the opening shapes on both sides, the flaps rise up by themselves and become rising portions, and when the packing implement is housed in the outer case, the upper edges of the flaps are supported on the bottom surface of the upper bottom of the outer case, so that the packing implement in an integral state can be stably housed in the outer case.

DESCRIPTION OF REFERENCE NUMERALS

1 Board
2, 2*a* Holding sheet
3 Base
3*a* Article holding region
4 Cover
4*a* Fold-back portion
4*b* Window frame portion
5 Window hole
6*a*, 6*b* Flap
7 Protruding edge
7*a* Slit
8 Packing implement
9 Outer case
L0, L1, L2, L3 Folding line

BEST MODE FOR CARRYING OUT THE INVENTION

The object to stably hold a thin card-shaped article is achieved by sandwiching the thin card-shaped article between the base and the cover, folding the base and both side edges of the cover together, and pressing and fixing the thin card-shaped article to the base by a holding sheet stuck over the inside of the window hole of the cover.

EXAMPLE 1

(1) Configuration of Packing Implement

Figure 1:
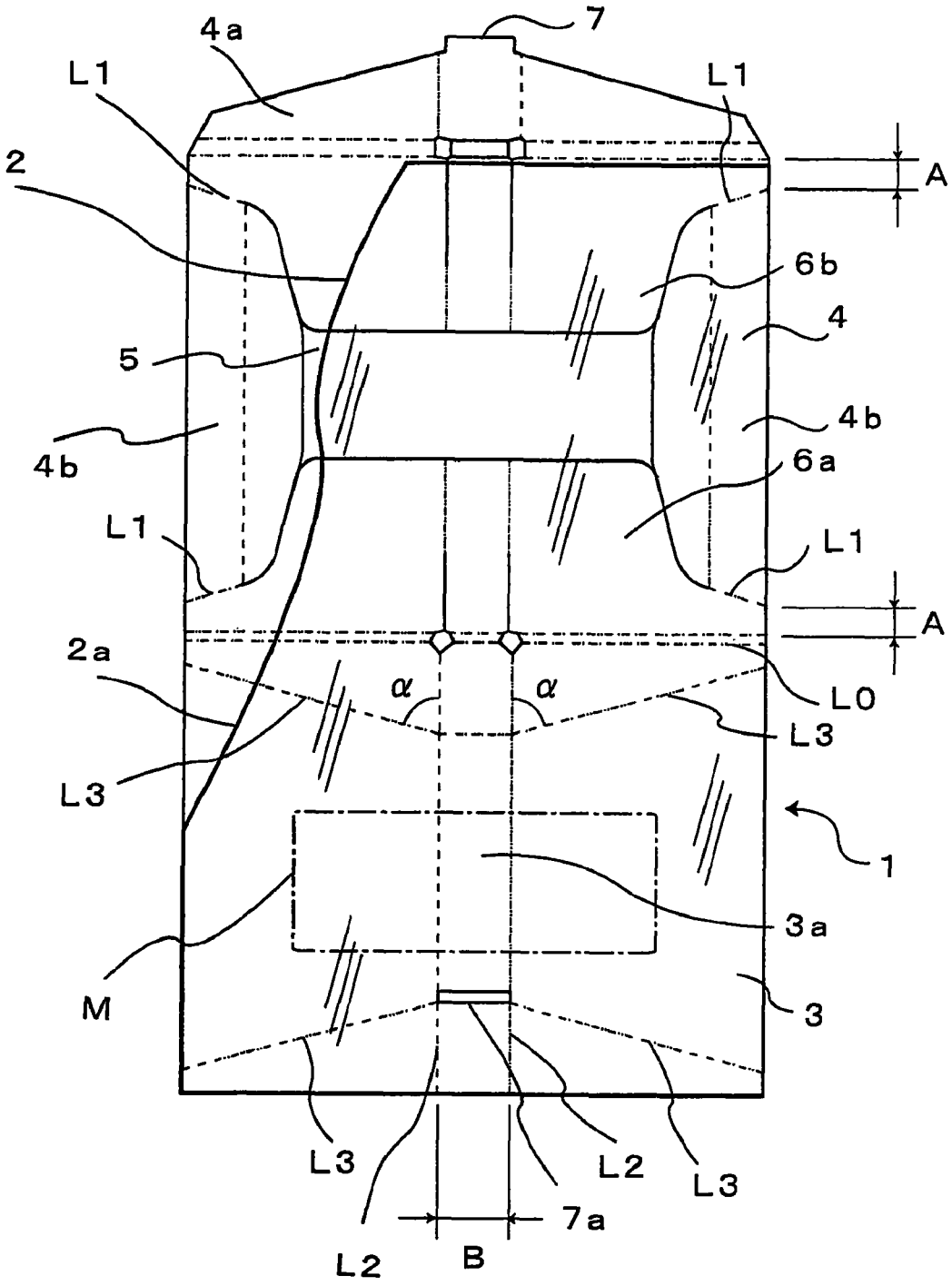
FIG. 1 is a partially sectional enlarged plan view showing a developed shape of a packing implement according to the present invention.

A packing implement for article transportation according to the present invention uses a combination of a board 1 and a holding sheet 2 as shown in FIG. 1. The board 1 is made of a corrugated cardboard and the board surface is sectioned into a base 3 and a cover 4 by a folding line L0 drawn at substantially the central portion of the board.

The base 3 is a board surface on which an article M is placed, and in the central region of the board surface of the base 3, two folding lines L2 and L2 are set parallel to each other across the board surface of the cover 4 at a predetermined interval shown as B, and on the board surface of the base 3, folding lines L3 and L3 are set at an a angle in a downward slope direction from the folding lines L2 to both side edges so as to secure a necessary height for forming falling portions. In the board surface of the cover 4, a window hole 5 is opened in the manner described later, and in this example, a pair of flaps 6*a* and 6*b* are provided so as to be opposed to each other and project from both sides of the window hole 5 to the inner side of the window hole 5, and further, on one side outer edge of the cover 4, a fold-back portion 4*a* is provided.

The pair of flaps 6*a* and 6*b* are erected perpendicularly to the board surface from both end edges while leaving parts of both side edges of the cover 4 as the window frame, and on the board surface of the cover 4 which becomes the window frame, folding lines L1 and L1 are set so as to slope downward while leaving an interval A necessary for forming the height of the falling portions.

The holding sheet 2 is a synthetic resin sheet (for example, urethane sheet) which is transparent and has elasticity, and is stuck over the inside of the opening of the window hole 5 of the cover 4 to close the opening of the window hole 5, and in this example, the holding sheet 2 is extended from the board surface of the cover 4 to the base 3 side and stuck over the board surface of the base 3. Hereinafter, the portion of the holding sheet 2 stuck over the board surface of the base 3 is designated by the reference numeral 2*a* and is distinguished from the portion 2 of the holding sheet stuck over the entire surface of the cover 4 while covering the window hole 5.

The holding sheet 2 is stuck across the board surface of the base 3 and the board surface of the cover 4, and the holding sheet 2 is stuck over the cover 4 at the opening edges of the four peripheral sides of the window hole 5, however, with respect to the base 3, the holding sheet 2 is not necessarily stuck over the four peripheral sides or the entirety of the board surface of the base 3 as long as the holding sheet 2 is stuck over the board surface of the base 3 which becomes the article holding region 3*a* of the base 3 as holding sheet 2*a*.

In this example, the holding sheet 2*a* is stuck to only both end edges of the base 3. Of course, the holding sheet 2*a* is stuck to the surface of the base 3 for isolating the article from the paper surface of the corrugated cardboard of the base 3 and protecting the article from breakage and damage to be caused by contact with the corrugated cardboard surface, and when such article protection is not necessary, it is not necessary to stick the holding sheet 2*a* across the surface of the base 3.

In the figure, the portion of the width B between the folding lines L2 and L2 on the base 3 is the article holding region 3*a*, and the article M is placed on the board surface of the base 3 across the article holding region 3*a*. As described later, the cover 4 is folded double over the base 3 on which the article M is placed, both flaps 6*a* and 6*b* are erected to form rising portions, and further, both side edges of the base 3 and the cover 4 are folded down integrally as falling portions, and accordingly, the board 1 is built up as a three-dimensional packing implement.

In the present invention, the cover 4 is folded over the board surface of the base 3, and both side edges thereof are folded down, and accordingly, both flaps 6*a* and 6*b* rise by themselves and a window hole 5 is formed in the board surface of the cover 4, and the base 3 and the cover 4 slope downward to both ends from the central regions as their borders, and the holding sheet 2 facing the inside of the window hole 5 is tensioned according to the slope of the base 3. Accordingly, the article M is pressed down to the holding sheet 2 and held at a fixed position on the base 3. According to the present invention, a packing implement packing an article M is housed as it is in an outer case, and the article M is stably housed in the outer case.

(2) Way of Packing

Figure 2A:
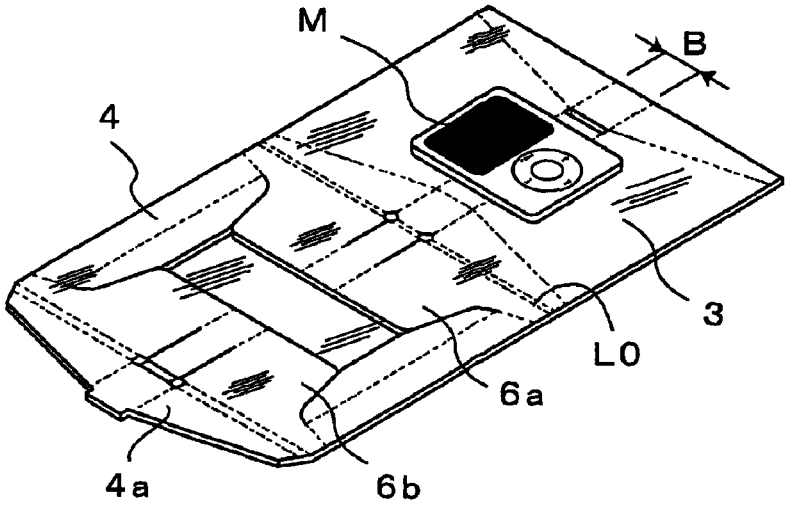
FIGS. 2(*a*) to 2(*c*) are views showing steps of packing an article by using the packing implement.
Figure 2B:
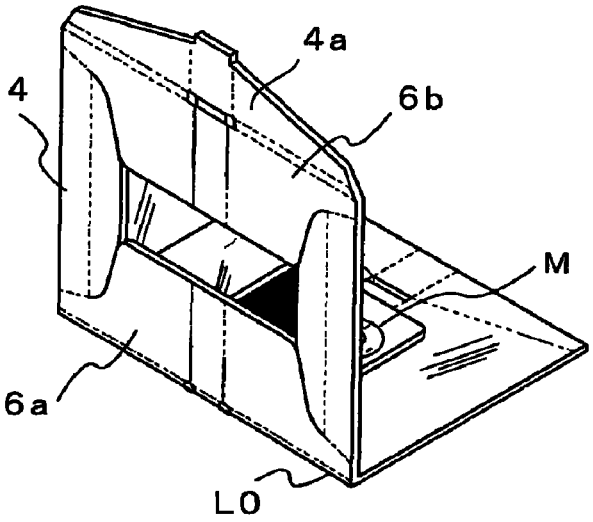
Figure 2C:
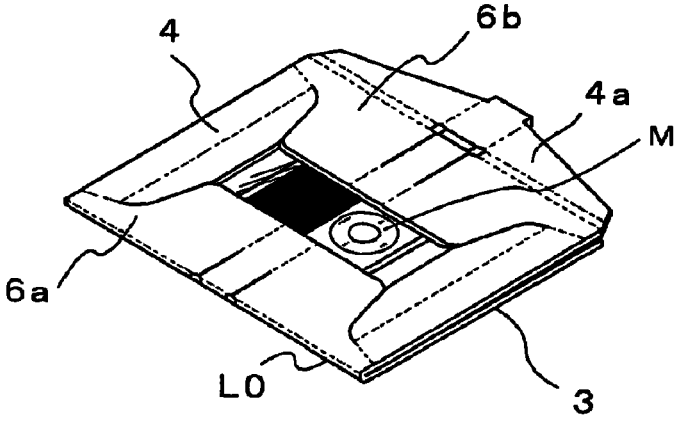

Next, a way of packing a thin card-shaped article by using the packing implement of the present invention will be described. In FIG. 2(*a*), the board surface of the base 3 and the board surface of the cover 4 are spread on the same plane, and a thin card-shaped article (for example, iPod (trade name)) M is placed on the central region of the base 3. When the holding sheet 2*a* is laid over the base 3, the article M is placed on the article holding region 3*a* on the holding sheet 2*a*.

In FIG. 2(*b*), the cover 4 is folded along the central folding line L0 and erected upward. Further, as shown in FIG. 2(*c*), the cover 4 is folded double over the base 3 to sandwich the article M between the cover 4 and the base 3.

Figure 3A:
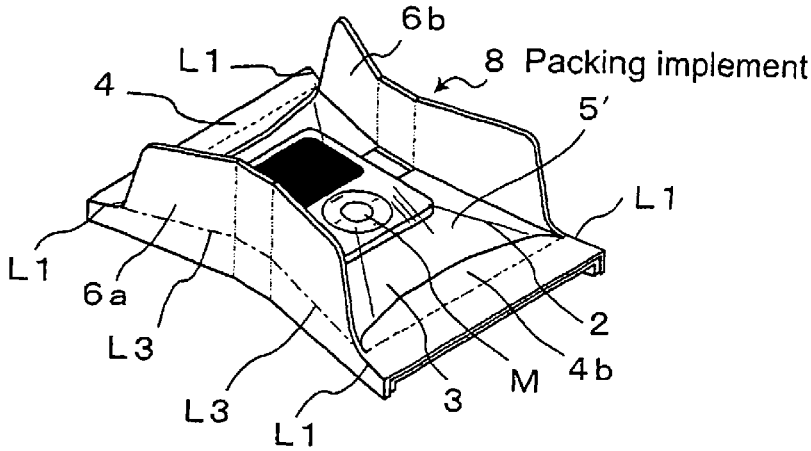
FIGS. 3(*a*) and 3(*b*) are views showing steps of building-up and housing the packing implement in an outer case.
Figure 3B:
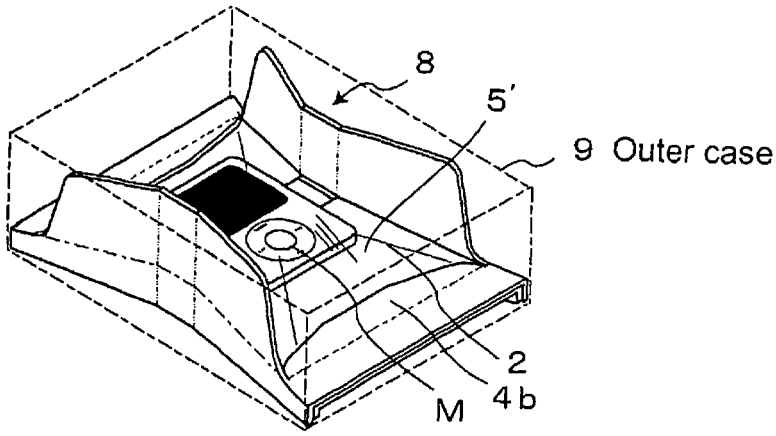

In the state where the cover 4 is folded over the base 3, next, as shown in FIG. 3(*a*), both outer sides of the cover 4 are folded down along the folding lines L3 and L3 of the base 3. Accordingly, the cover 4 is folded along the folding lines L1 and L1, both flaps 6*a* and 6*b* erect in a vertical posture, a window hole 5 is opened in the center of the cover 4, and at the same time, falling portions are formed on both sides of the base 3, and further, by erecting both flaps 6*a* and 6*b*, rising portions are formed, and accordingly, a three-dimensional packing implement 8 is built up.

By folding the base 3 down together with both outer sides of the cover 4 along the folding lines L3 and L3, the flaps 6*a* and 6*b* erect in a vertical posture, intervals between the flaps are parallel and the lateral width (the lateral width of the interval B between the folding lines L2 and L2 (refer to FIG. 1)) of the base 3 is narrow in a predetermined central section and the lateral width expands toward both ends so that the board surface of the base has a drum (Japanese instrument "TUDUMI") shape in a plan view, and the board surface of the base 3 has a center-high shape which is high in the central section of the interval B, and becomes lower toward the front and rear ends.

Specifically, the packing implement 8 three-dimensionally built up has a constriction in the central region as viewed from above, and is deformed into a center-high shape which slopes downward to the both ends of the packing implement from the central region. On the other hand, the holding sheet 2 stuck over the inside of the window hole 5 of the cover 4 is pulled to both sides and tensioned from the central portion to both end portions to hold the article M at a predetermined position on the base 3. By erecting the flaps 6*a* and 6*b*, the cover 4 is left as window frame portions 4*b* and 4*b* on both ends, and the window frame portions 4*b* and 4*b* are brought into pressure-contact with the slope surfaces 5' of the base 3 and press the holding sheet 2 against the board surface of the base 3 and increase the tension of the holding sheet 2 to stably hold the article. By setting the projecting lengths of the window frame portions 4*b* and 4*b* to be long, the holding sheet 2 can be pressed against a wide area of the board surface of the base 3, and as a result, the force of pressing the holding sheet 2 against the base 3 is increased and the article holding stability can be increased.

Next, the fold-back portion 4*a* is folded back to the inside of the falling portions, and as shown in FIG. 1, a protruding edge 7 provided on a part of the fold-back portion 4*a* is inserted into a slit 7*a* opened in a part of the base to prevent the base 3 folded back downward from snapping back together with the cover 4, and while both flaps 6*a* and 6*b* are held by hand, as shown in FIG. 3(*b*), the packing implement is housed in the outer case 9.

In the present invention, the size of the outer case 9 has an area within which the packing implement 8 fits, and has a depth set from the lower edges folded down as falling portions of the packing implement 8 to the height of the upper edges of the flaps 6*a* and 6*b* which are folded upward. In FIG. 1, by setting a wide interval A necessary to form the height of the falling portions, a thick article can be packed, and by setting a wide interval B between the folding lines L2 and L2 on the base 3, the article supporting stability can be increased.

In this outer case 9, the packing implement 8 packing the article M is housed, and the outer case 9 is lidded. The packing implement 8 housed in the outer case 9 has four corners supported by the four corners of the outer case 9 so as to keep its shape and keep the predetermined form as when it was folded, and the article M is pressed down by the holding sheet 2 and stably held at the central portion of the article holding region 3*a* of the base 3.

In the present invention, the article M is sandwiched and held between the smooth holding sheet 2*a* laid on the base 3 and the smooth holding sheet 2 stuck across the inside of the window hole 5 of the cover 4, so that the article is not damaged with flaws etc., by the corrugated cardboard, and even if the article is strongly pressed from the upper holding sheet 2 or the outer case 9 is dropped by mistake and subjected to a great impact during transportation, the article M packed by the packing implement 8 in the outer case 9 is not damaged. Therefore, the packing implement of the present invention does not need to be further wrapped by a plastic bag or Air Cap, and can effectively protect the article.

After transportation, to take the packing implement 8 out from the outer case 9, the lid of the outer case 9 is opened and the packing implement 8 is pulled up by grasping the constriction formed by deformation of the cover 4 and the base 3, so that the packing implement 8 is easily taken out from the outer case 9, and the cover 4 and the base 3 of the taken-out packing implement 8 almost restore to be flat due to the power of resilience of the board 1, so that the cover 4 is opened from the base 3 and the article M can be easily taken out from the packing implement 8.

INDUSTRIAL APPLICABILITY

A packing implement according to the present invention can be easily built up by cutting and folding corrugated cardboard, and easily packs and unpacks an article, and is very suitable as a packing implement for home delivery service of a factory-produced product, particularly a thin card-shaped article.

The invention claimed is:

1. A packing implement for thin article transportation to be housed in an outer case, the packing implement comprising:

a board having a base supporting a thin article to be transported at a fixed position, and being folded in a sloping direction from a region in which the article is placed toward both ends, and a cover folded over the base, and having a window hole and flaps provided thereon, and a stretchable holding sheet stuck over opening edges of the window hole of the cover to press the thin article placed on a central region of the base against the base when the cover is folded over the base, wherein both side edges of the base are folded downward along slopes of the base to form falling portions of the packing implement, and pull the holding sheet to both sides along a slope of the base and tense the holding sheet from the central portion to both end portion sides, the flaps are folded up, upon forming the falling portions, to become rising portions of the packing implement extending continuously upwardly from the falling portions of the base beyond the base, and four corners of the rising portions of the packing implement housed in the outer case are supported by four corners of the outer case, and upper edges of the rising portions are supported by a lid which lids the outer case.

2. The packing implement for thin article transportation according to claim 1, wherein the flaps are provided so as to project to an inner side of an opening of the window hole and be opposed to each other, the falling portions are formed on both sides of a board surface of the base by folding lines which have central portions being high and form slopes to lower in height from the central portions to both ends, and by folding the falling portions, the base is formed into a shape which is narrow in width at central portions and becomes wider and slopes down to both ends, and by erecting both flaps, the flaps form rising portions following shapes of the base along both outer surfaces of the falling portions.

3. The packing implement for thin article transportation according to claim 1, wherein by erecting upward the flaps along both side edges of the base, the falling portions are formed along folding lines on both sides of the base, and the holding sheet stuck over an inside of the window hole of the cover is brought into pressure contact with a surface of the base, and presses the article placed on a central portion of the base against the base.

4. The packing implement for thin article transportation according to claim 3, wherein the packing implement is three-dimensionally built up by erecting the flaps, the packing implement three-dimensionally built up has a constriction formed in a central region as viewed from above, and slopes down from the central region to both ends of the packing implement so as to deform into a center-high shape, and the base stably supports the article on a fixed region of the central portion by a strong pressing force caused by tension of the holding sheet.

5. A packing implement for thin article transportation which includes a board and a holding sheet and is to be housed in an outer case, wherein the board is sectioned into a base and a cover, the base supports a thin card-shaped article to be transported at a fixed position, and is folded in a sloping direction from a region in which the article is placed toward both ends, the cover is folded over the base, has a window hole, and flaps provided thereon, the holding sheet is a synthetic resin sheet being stretchable, and is stuck over opening edges of the window hole of the cover to press the thin card-shaped article placed on a central region of the base against the base when the cover is folded over the base, both side edges of the cover and the base are folded downward along slopes of the base to form falling portions of the packing implement, and pull the holding sheet to both sides along a slope of the base and tense the holding sheet from the central portion to both end portion sides, the flaps are folded up to become rising portions of the packing implement, four corners of the rising portions of the packing implement housed in the outer case are supported by four corners of the outer case, and upper edges of the rising portions are supported by a lid which lids the outer case, the cover is left as frame portions by erecting flaps on both sides, and the frame portions are pressure-bonded to the sloping surfaces of the base sloping up from both end edges to the central portion from above the holding sheet stuck over the cover.

6. The packing implement for thin article transportation according to claim 1, wherein the holding sheet stuck over the opening edges of the window hole of the cover is extended and stuck across the cover and the board surface of the base and interposed between the article placed on the base and the base to isolate the article from the board surface of the base.

7. A packing implement for thin article transportation which includes a board and a holding sheet and is to be housed in an outer case, wherein the board is sectioned into a base and a cover, the base supports a thin card-shaped article to be transported at a fixed position, and is folded in a sloping direction from a region in which the article is placed toward both ends, the cover is folded over the base, has a window hole, and flaps provided thereon, the holding sheet is a synthetic resin sheet being stretchable, and is stuck over opening edges of the window hole of the cover to press the thin card-shaped article placed on a central region of the base against the base when the cover is folded over the base, both side edges of the cover and the base are folded downward along slopes of the base to form falling portions of the packing implement, and pull the holding sheet to both sides along a slope of the base and tense the holding sheet from the central portion to both end portion sides, the flaps are folded up to become rising portions of the packing implement, four corners of the rising portions of the packing implement housed in the outer case are supported by four corners of the outer case, and upper edges of the rising portions are supported by a lid which lids the outer case, the cover has a turn-over portion on one side outer edge, and the turn-over portion is folded back to the inside of the falling portions after the cover is folded over the base, and a protruding edge provided on a part of a fold-back portion is inserted into a slit opened in a part of the base to prevent resilience from being caused by the folds of the base and the cover.

8. The packaging implement for thin article according to claim 1, wherein each of the flaps is arranged substantially perpendicularly to the base and extends from a bottom of each of the falling portions vertically upwardly without interruption.

* * * * *